United States Patent [19]

Dezelan et al.

[11] 4,132,290

[45] Jan. 2, 1979

[54] LOCKING MECHANISM FOR MOVABLE VEHICLE MEMBERS

[75] Inventors: Joseph E. Dezelan, Western Springs; Donald R. Mast, Decatur, both of Ill.

[73] Assignee: Caterpillar Tractor Co., Peoria, Ill.

[21] Appl. No.: 759,219

[22] Filed: Jan. 13, 1977

[51] Int. Cl.[2] ..... B62C 7/02

[52] U.S. Cl. ..... 188/69; 91/415; 172/789; 172/795

[58] Field of Search ..... 188/31, 60, 69; 74/813 C, 813 L, 826; 91/415, 417 R; 172/789, 791-793, 795-797

[56] References Cited

U.S. PATENT DOCUMENTS

| | | | |
|---|---|---|---|
| 3,118,347 | 1/1964 | Thompson | 74/826 X |
| 3,138,884 | 6/1964 | Hein et al. | 37/129 |
| 3,227,050 | 1/1966 | Hein et al. | 91/436 |
| 3,454,110 | 7/1969 | Hanser | 172/793 |
| 3,583,493 | 6/1971 | Wadelton | 172/225 |
| 3,692,149 | 9/1972 | Evans | 188/69 |
| 3,698,617 | 10/1972 | Fukaya et al. | 91/415 X |
| 3,739,861 | 6/1973 | Johnson et al. | 172/793 |

OTHER PUBLICATIONS

*Lift Arm Locking Valve and Pin,* John Deere, Pub. TM-1123, 1975.

*Primary Examiner*—George E. A. Halvosa
*Attorney, Agent, or Firm*—John L. James

[57] ABSTRACT

A locking mechanism is provided for an apparatus having a first member movable relative to a second member providing a plurality of spaced holes therein including: a housing secured to the first member; a lock pin extendably retractably mounted in the housing for insertion into the holes in the second member; and a powered control circuit having an actuated member movably mounted within the housing and connected to the lock pin, the actuator member providing differential force applying surfaces selectively exerting a predetermined locking force to hold the lock pin in the holes and a lower indexing force permitting substantially unrestricted relative movement between the first and second members and automatic insertion of the pin into one of the aligned holes.

4 Claims, 3 Drawing Figures

LOCKING MECHANISM FOR MOVABLE VEHICLE MEMBERS

BACKGROUND OF THE INVENTION

Vehicles designed for earthmoving applications are frequently equipped with earthmoving implements that are variably positonable. Motor graders, for example, may be equipped with blade control systems, such as a center shift mechanism, which enable the operator to select a wide variety of blade positions. The center shift mechanism is held in one of the variable preselected positions by a locking arrangement consisting of a lock pin and an actuating control circuit. Examples of such locking arrangements may be found in U.S. Pat. No. 3,692,149, issued Sept. 19, 1972 to J. H. Evans, in U.S. Pat. No. 3,739,861 which issued June 18, 1973 to H. M. Johnson et al., and in John Deere publication TM-1123 dated Feb. 1975.

However, such prior art locking arrangements are awkward and inefficient to use. The alignment of the variable position implement system is achieved by simultaneous manipulation of the system controls and visual observation of the members as they move from one preselected position to another. The lock pin cannot be engaged properly if these members are not aligned, and failure to completely engage the lock pin may result in damage to the vehicle or improper operation. A method of automatically engaging the lock pin with an indexing force upon alignment of the members is desired. However, the relatively great locking force is not suitable for this purpose, because as the lock pin slides across the face of the locking member, it would cause excessive wear or damage to the locking mechanism and to other members of the center shift mechanism. Additionally, the pin impinging on the locking member under the substantial locking force creates a braking force which acts on the center shift mechanism. This braking force in turn places a greater burden upon the vehicle power system and results in a reduction in efficiency.

SUMMARY OF THE INVENTION

Accordingly, it is an object of the present invention to provide an improved locking mechanism for releasably locking movable members in one of a plurality of preselected positions.

Another object is to provide a limited force sufficient to engage the lock pin automatically when the members are aligned in a preselected position, but not sufficient to cause excessive wear or damage to system components as the members are being aligned and a greater, locking force upon engagement of the lock pin.

Another object is to provide a limited force for initial engagement of a lock pin by pressurizing the opposite sides of a differential area piston and a relatively greater locking force by pressurizing only one side of the piston.

Other objects and advantages of the present invention will become more readily apparent upon reference to the accompanying drawings and the following description.

DETAILED DESCRIPTION OF THE INVENTION

Figure 1:
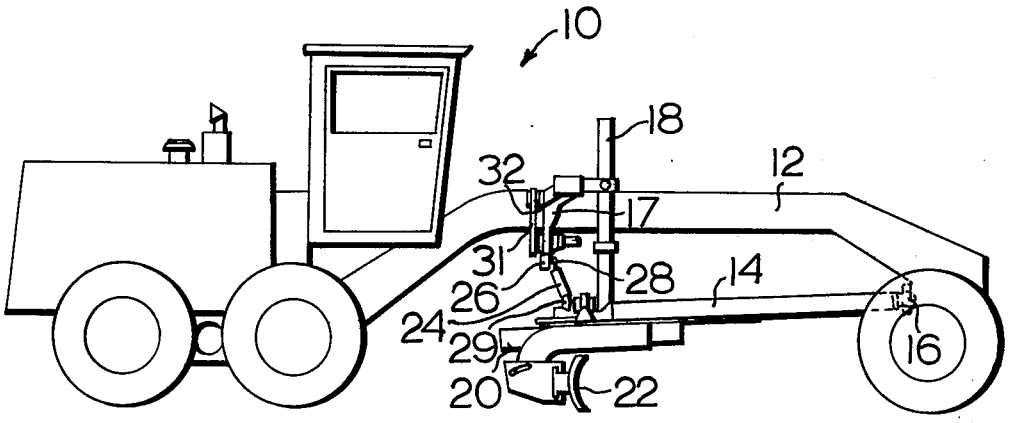
FIG. 1 is a side elevational view of a motor grader incorporating movable members and the locking mechanism of the present invention.

Referring to FIG. 1, a motor grader 10 has a main frame 12 and a drawbar 14 with a first end connected for universal movement to the forward end of the main frame as indicated at 16 and a second end supported by a pair of double-acting hydraulic jacks 18, only one of which is shown. The jacks 18 are individually pivotally supported on one of a pair of bell cranks, one shown at 17, pivotally mounted to the frame 12. Attached to the second end of the drawbar are a blade circle 20 and a removable blade 22. The drawbar is shifted in a transverse direction by a double-acting hydraulic jack 24 having its rod and cylinder head ends pivotally connected to a link bar 26 and the drawbar by means of a pair of ball joints 28 and 29, respectively, as is known in the art. The link bar 26 is pivotally supported at its opposite ends by the pair of bell cranks 17 and includes a transverse centrally disposed bore 30, FIG. 2. A transversely elongated lock plate 31 having a face 32 is secured to frame 12 in generally horizontal alignment with link bar 26 and includes a plurality of holes, one of which is shown at 33, FIG. 2. The locking mechanism of this invention is shown generally by numeral 34.

Figure 2:
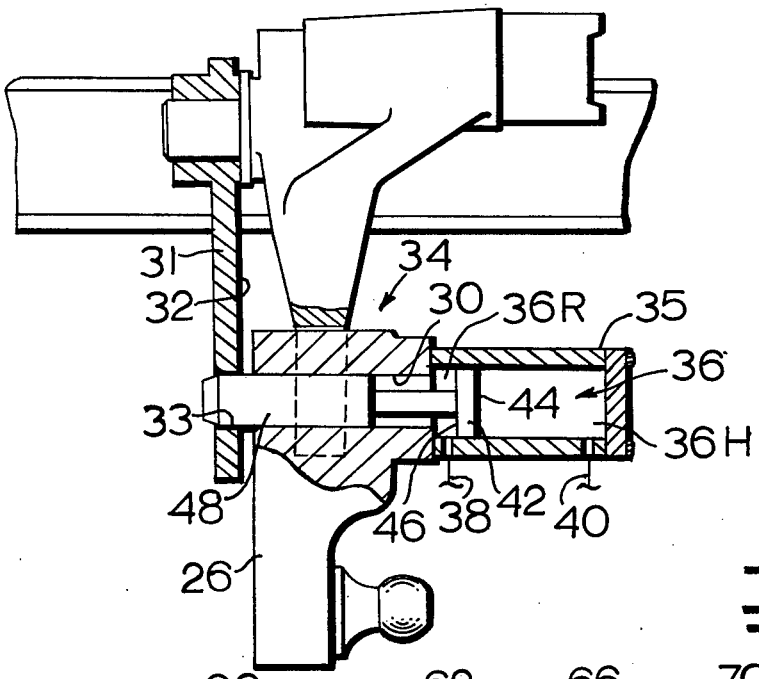
FIG. 2 is a longitudinal sectional view of the movable members and locking mechanism with portions broken away for illustrative purposes.

Referring to FIG. 2, the locking mechanism 34 has a housing 35 secured to the link bar 26 for movement therewith. The housing 35 has a chamber 36 and first and second ports 38 and 40, on opposite ends of and in fluid communication with the chamber.

A piston 42 having a first surface area 44 and an opposed second smaller surface area 46 is slidably positioned within the chamber 36 dividing it into a rod end chamber 36R and a head end chamber 36H. A lock pin 48 is generally coaxially seucred to the piston and projects outwardly from the housing 35 through the bore 30 in the link bar 26 and further projecting into one of the plurality of prepositioned holes 33 formed in lock plate 31.

Figure 3:
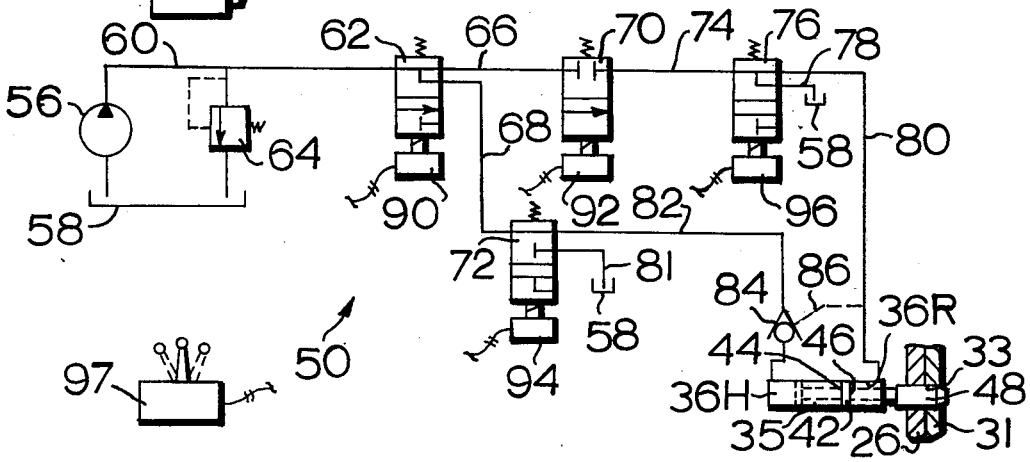
FIG. 3 is a schematic showing the pressurized fluid control system for the locking mechanism.

Control of the locking mechanism is accomplished by a fluid control circuit illustrated schematically at 50 in FIG. 3. The control circuit has a pump 56 adapted to draw fluid from a reservoir 58 for supply through a line 60 to a valve 62. A relief valve 64 is disposed between the line 60 and the reservoir 58 to limit the maximum pressure in the system to a predetermined safe value. The valve 62 communicates by way of a pair of lines 66 and 68 with a pair of valves 70 and 72, respectively. The valve 70 is connected by a conduit 74 to a valve 76, which in turn is in fluid communication with the reservoir 58 and the chamber 36R through lines 78 and 80, respectively. The valve 72 is connected to the reservoir 58 by way of a line 81 and to the chamber 36H by a line 82. Pilot operated check valve 84 is disposed in the line 82 normally to block fluid flow from the chamber 36H and is responsive to pressure in the line 80 by way of the line 86. The valves 62, 70, 72 and 76 are individually controlled by a plurality of electric solenoids 90, 92, 94 and 96, respectively, which may be substantially energized or de-energized by a remotely mounted switch 97.

OPERATION

While the operation of the present invention is clearly apparent from the foregoing description, further amplification will subsequently be made in the following brief summary of such operation.

Referring to FIG. 3, the system is illustrated in the lock position. The solenoids 90, 92, 94 and 96 are deenergized. To retract the lock pin 48 from the lock position, the switch 97 is moved to a second position to energize the solenoids urging the valves 62, 70, 72 and 76 to a second position. Pressure from the pump 56 is communicated by way of the line 60 to the valve 62 which further directs the pressure by way of the valves 70 and 76 in series with lines 66, 74 and 80 to the chamber 36R in housing 35. A pilot pressure signal from the line 80 is directed by way of the pilot line 86 to open the pilot operated check valve 84. The check valve prevents the loss of fluid from the head end chamber and prevents accidental contraction of the rod end chamber in the event of a pressure loss in the system. Fluid in the head end chamber 36H is communicated to the valve 72 by way of the line 82 and the check valve 84 disposed therein. The valve 72 directs the fluid into the reservoir 58 by way of the line 81. Pressure in the chamber 36R acts upon the piston surface area 46 urging the piston 42 and the lock pin 48 leftwardly to a position indicated by the broken lines in FIG. 3 whereby the lock pin 48 is retracted from one of the holes 33 formed in the lock plate 31.

To change center shift position the vehicle operator retracts the lock pin 48 from the lock plate 31 as described above. Using the supporting hydraulic jacks 18 and the center shift jack 24 the drawbar 14 is shifted to one of a plurality of preselected positions which results in movement of the link bar 26 transversely of frame 12. The switch 97 is placed in a third position which energizes the solenoids 92 and 96 and de-energizes the solenoids 90 and 94. The valves 70 and 76 are shifted to a second position and the valves 62 and 72 are shifted to a first position as described above. Pressure from the pump 56 is communicated by way of the line 60 to the valve 62 which directs pressure to the valves 70 and 72 by way of the lines 66 and 68. The valve 70 communicates the pressure to the chamber 36R by way of the line 74, the valve 76, and the line 80. The valve 72 communicates the pressure to the chamber 36H by way of the line 82 and the check valve 84. The pressure acting upon the opposed piston areas 44 and 46 produces a net indexing force which urges the piston 42 and the lock pin 48 outwardly from the housing 35. As the link bar 26 moves relative to the lock plate 31, the lock pin slidably moves across the face 32 of the lock plate. When proper alignment of lock pin 48 and one of the prepositioned holes 33 in the lock plate 31 is achieved, the indexing force acting on the lock pin 48 forces the lock pin into the hole.

The lock pin 48 is thereafter secured in position by moving switch 97 to the lock position. The solenoids 90, 92, 94, and 96 are de-energized, and the valves 62, 70, 72, and 76 are urged by resilient means to the positions shown in FIG. 3. Pressure from the pump 56 is communicated by way of the line 60 to the valve 62 and is further directed by the lines 66 and 68 to the valves 70 and 72, respectively. The valve 70 blocks pressure in the line 66. The valve 72 communicates pressure by way of the line 82, through the check valve 84 to the chamber 36H, where it acts upon piston surface area 44 generating a force which urges piston 42 and lock pin 48 outwardly from the housing, through bore 30 in link bar 26 and into one of the plurality of prepositioned holes 33 formed in the lock plate 31. Fluid in the chamber 36R is vented by way of line 80 to valve 76 and line 78 to reservoir 58. The implement system, including the link bar and lock plate, is subjected to extremely high forces. Accordingly, a relatively great locking force is required to maintain engagement of the lock pin and to secure alignment of the link bar relative to the lock plate. However, a force of this magnitude, if utilized as the previously described indexing force, would cause excessive wear or damage to the system components. Therefore, a locking force is generated within a broad range, for example, of 2 to 10 times greater than the indexing force and preferably within a narrower range of 4 to 7 times greater than the indexing force. This is accomplished without complicated pressure controls by controlling the ratio of the piston surface area 44 and the effective differential surface area measured by the difference between areas 44 and 46.

In view of the foregoing, it is readily apparent that the structure of the present invention provides an improved locking arrangement that is capable of fixedly securing movable members of a system in a plurality of selectable positions. Furthermore, the locking mechanism provides a method of conveniently engaging the lock pin automatically with an indexing force when the members are aligned in a preselected position. Still further, the indexing and automatic engaging functions of the present invention are accomplished without causing excessive wear or damage to system members.

While the invention has been described and shown with particular reference to the preferred embodiments, it will be apparent that variations are possible which would fall within the spirit of the present invention, which is not intended to be limited, except by the scope of the following claims.

What is claimed is:

1. A locking mechanism adapted for an apparatus having a first member movable relative to a second member providing a plurality of spaced holes therein, comprising:

a housing secured to said first member having a chamber;

a piston having first and second surface areas, said first surface area being greater than said second surface area, said piston being movably positioned in the chamber;

a lock pin connected to said piston and extending outwardly from the housing, said lock pin being movable with the piston between a first position at which the lock pin is inserted into one of said holes and a second position at which the lock pin is displaced from said hole;

fluid means for moving the piston between the first and second positions and exerting fluid forces on both piston surface areas during movement of one member relative to the other said piston remaining at the first and second positions free of the fluid means; and control means having a first operating mode for directing pressurized fluid against only the second surface area of said piston for exerting a retracting force on the lock pin of a first preselected magnitude and in a first preselected direction for retracting said lock pin while said first surface area is free of fluid pressure, a second operating mode for directing pressurized fluid against only the first surface area of said piston for exerting an actuating force on the lock pin of a second preselected magnitude and in an opposed second direction for extending said lock pin fixedly connecting said first member to said second member while said second surface area is free of fluid pressure, said second force being greater than said first force, and a third operating mode for directing pressurized fluid against both first and second surface areas of said piston for exerting an indexing force on the lock pin for automatically inserting said pin into an aligned one of said holes upon scanning of said member having said holes therein as may be required for said alignment, said indexing force being of a magnitude less than said actuating force and in the direction of said actuating force, said first and second members being movable one relative to the other in the third mode prior to inserting the pin into the aligned hole.

2. The apparatus as set forth in claim 1 wherein said fluid means comprises:

a fluid reservoir;

a pressurized fluid source;

a fluid circuit having first, second, third and fourth valves, said first valve having first and second outlets and being connected to the pump, said second and third valves being connected in series with the first outlet of the first valve, said fourth valve being connected to the second outlet of the first valve, said third valve having a first oulet in communication with the second piston surface area and a second outlet in communication with the reservoir, and said fourth valve having a first outlet in communication with the first piston surface area and a second outlet in communication with the reservoir.

3. The apparatus as set forth in claim 2 including a pilot operated check valve connected between the second outlet of the fourth valve and the first piston surface area.

4. The apparatus as set forth in claim 3 including a pilot pressure line connected to the pilot operated check valve and to the first outlet of the third valve.

* * * * *